US008127705B2

(12) United States Patent
Kuklinski

(10) Patent No.: US 8,127,705 B2
(45) Date of Patent: Mar. 6, 2012

(54) WATER ENTRY SYSTEM

(75) Inventor: Robert Kuklinski, Portsmouth, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 289 days.

(21) Appl. No.: 12/560,523

(22) Filed: Sep. 16, 2009

(65) Prior Publication Data

US 2011/0061584 A1 Mar. 17, 2011

(51) Int. Cl.
*B63G 8/08* (2006.01)
*B63B 1/38* (2006.01)

(52) U.S. Cl. ..... 114/337; 114/67 A

(58) Field of Classification Search ..... 114/337, 114/278, 289, 288, 145 R, 67 R, 67 A; 440/66
See application file for complete search history.

(56) References Cited

U.S. PATENT DOCUMENTS

| | | | | |
|---|---|---|---|---|
| 1,247,430 | A | 11/1917 | Loomis | |
| 1,295,047 | A | 2/1919 | Louden | |
| 1,859,139 | A * | 5/1932 | Hanlon | 114/67 R |
| 2,330,674 | A * | 9/1943 | Briggs | 114/151 |
| 2,699,644 | A * | 1/1955 | Coanda | 440/38 |
| 3,044,559 | A * | 7/1962 | Chajmik | 416/228 |
| 4,005,319 | A * | 1/1977 | Nilsson et al. | 310/339 |
| 4,718,273 | A * | 1/1988 | McCormack | 73/180 |
| 5,282,763 | A * | 2/1994 | Dixon | 440/42 |
| 5,401,195 | A * | 3/1995 | Yocom | 440/6 |
| 5,511,504 | A * | 4/1996 | Martin | 114/61.12 |
| 6,032,087 | A * | 2/2000 | Yamamoto | 701/21 |
| 2010/0170427 | A1 * | 7/2010 | Brulhart | 114/174 |

FOREIGN PATENT DOCUMENTS

JP 05001698 A * 1/1993

* cited by examiner

*Primary Examiner* — Stephen Avila
*Assistant Examiner* — Andrew Polay
(74) *Attorney, Agent, or Firm* — James M. Kasischke; Michael P. Stanley; Jean-Paul A. Nasser

(57) ABSTRACT

A water entry system increases the drag of an underwater vehicle by disrupting the cavity that forms during high-speed transit of the vehicle through the water. A series of inlet ports are positioned in regions of the vehicle where pressure stagnation occurs during transit. Flow passages connect these inlets to outlet ports at regions of lower pressure. Pressure differences cause jets to flow in the respective passages. The jets produce a high flow rate normal to the original cavity boundary. The jets serve to increase drag in at least two manners. In one case, a flow jet normal to the cavity interface broadens the cavity to increase drag and slow the vehicle. In a second case, a jet can cause waves on the cavity interface to break down the stable cavity. As a result, the vehicle surface is wetted, producing skin friction drag and slowing vehicle.

14 Claims, 2 Drawing Sheets

WATER ENTRY SYSTEM

STATEMENT OF GOVERNMENT INTEREST

The invention described herein may be manufactured and used by or for the Government of the United States of America for governmental purposes without the payment of any royalties thereon or therefore.

CROSS REFERENCE TO OTHER PATENT APPLICATIONS

Not applicable.

BACKGROUND OF THE INVENTION (1) Field of the Invention

The present invention relates to water entry of unmanned underwater vehicles and more specifically to suppression of cavity formation upon entry of such vehicles into the water.

(2) Description of the Prior Art

Underwater vehicles, such as torpedoes, are generally designed for speed, reliability and stealthy operation. Such vehicles are often introduced into the water by means of a high-speed air launch platform or via an in-air rocket launch system from a surface ship.

As is known in the art, upon impact with water of an object traveling at high-speed, a cavity is quickly established about the object behind its front most, portion. The cavity causes only the front most portion of the object to be in contact with the liquid. As a result, the body only experiences pressure drag during the cavity formation and added mass phases, i.e., when the body accelerates the fluid elements from rest. There is virtually no skin friction drag on the body. Since the cavity greatly reduces drag, the body can travel a considerable distance in the fluid before it slows to the point where the cavity closes on the underwater body.

The drag associated with an object is a function of how large, how heavy and how blunt the object entering the water is. An unmanned underwater vehicle (UUV), such as a torpedo or other torpedo-shaped object, will travel a considerable distance as it enters the water due to the formation of the cavity. This results in the need for high-speed water entries of such vehicles to be conducted in sufficiently deep water or at lower speeds. These restrictions reduce the allowable operational window for an air-dropped UUV.

What are needed are systems to increase the drag of an underwater vehicle without compromising vehicle stealth. In addition, there is a need to reduce the speed of the vehicle after entering the water to improve operation in shallow water environments. Further, the systems need to be integrated into current UUV hull configurations. Still further, there is a need that the systems not interfere with normal vehicle operations.

SUMMARY OF THE INVENTION

It is therefore a general purpose and primary object of the present invention to provide systems for increasing the drag of an underwater vehicle so as to slow its speed through the water.

The drag is increased by disrupting the cavity that forms during high-speed transit of the vehicle through the water. A series of inlet ports are positioned in regions of the vehicle where pressure stagnation occurs during transit. Flow passages connect these inlets to outlet ports at regions of lower pressure. Pressure differences between respective inlet and outlet ports cause flow jets of air or water in the respective passages. The jets produce a high flow rate normal to the original cavity boundary.

The jets serve to increase drag in at least two manners. In one case, the flow jet normal to the cavity interface broadens the cavity to increase drag and slow the vehicle. In a second case, the jets cause waves on the cavity interface to break down the stable cavity. As a result, the vehicle surface is wetted, skin friction drag is produced and the vehicle slows.

In one embodiment, a cavity reducing system for an aquatic vehicle increases drag on an underwater vehicle. The system includes one or more inlet ports positioned at a stagnation region of the vehicle. One or more outlet ports are positioned at a cavity formation region of the vehicle. The system further includes passageways connecting the inlet ports to the outlet ports. A pressure difference between one of the inlet ports and one of the outlet ports causes a flow of water through the connecting passageway. The outlet port directs the flow away from the vehicle to disrupt cavity formation about the vehicle and increase vehicle drag.

In another embodiment, one or more of the outlet ports are positioned at a propulsor region of the vehicle. In a further embodiment, closable covers are provided for the outlet ports. Closable covers can also be provided for the inlet ports. One or more sensors trigger operation of the covers depending on the speed of the vehicle. The sensors can be positioned within a forward portion of the vehicle adjacent the passageways.

In a further embodiment, a forward portion of a high-speed underwater vehicle comprises one or more inlet ports at a stagnation region of the forward portion; one or more outlet ports at a cavity formation region of the forward portion; and corresponding passageways through the forward portion to fluidly connect respective inlet ports and outlet ports. A flow from one inlet port through the passageway is directed by the outlet port to disrupt formation of a cavity about the forward portion.

In another embodiment, closable covers are provided for the outlet ports and one or more sensors within the forward portion initiate activation of the closable covers depending on a speed of the vehicle. The forward portion of the high-speed underwater vehicle can comprise instrumentation for controlling operation of the vehicle.

In another embodiment, an aquatic vehicle includes a stagnation region of the vehicle surface having an inlet port formed therein and a cavity formation region of the vehicle surface having an outlet port formed therein. The aquatic vehicle also includes a confined passageway through the, which fluidly connects the inlet port and the outlet port. The passageway is capable of confining a flow from the inlet port through the passageway to the outlet port. The flow is directed by the outlet port to disrupt formation of a cavity in the cavity formation region.

In a further embodiment, the vehicle includes a controller positioned within the vehicle and a closable cover for the outlet port. The controller selectively opens and closes the closable cover depending on a speed of the vehicle. In another embodiment, the vehicle further includes a propulsor region having a rear outlet port positioned therein. The vehicle can further include a controller positioned within said vehicle and a closable cover for the rear outlet port, which the controller selectively opens and closes depending on a speed of the vehicle. In addition, the propulsor region of the vehicle can include a rear inlet port positioned therein.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like references numerals and symbols designate identical or corresponding parts throughout the several views and wherein.

DETAILED DESCRIPTION OF THE INVENTION

Figure 1:
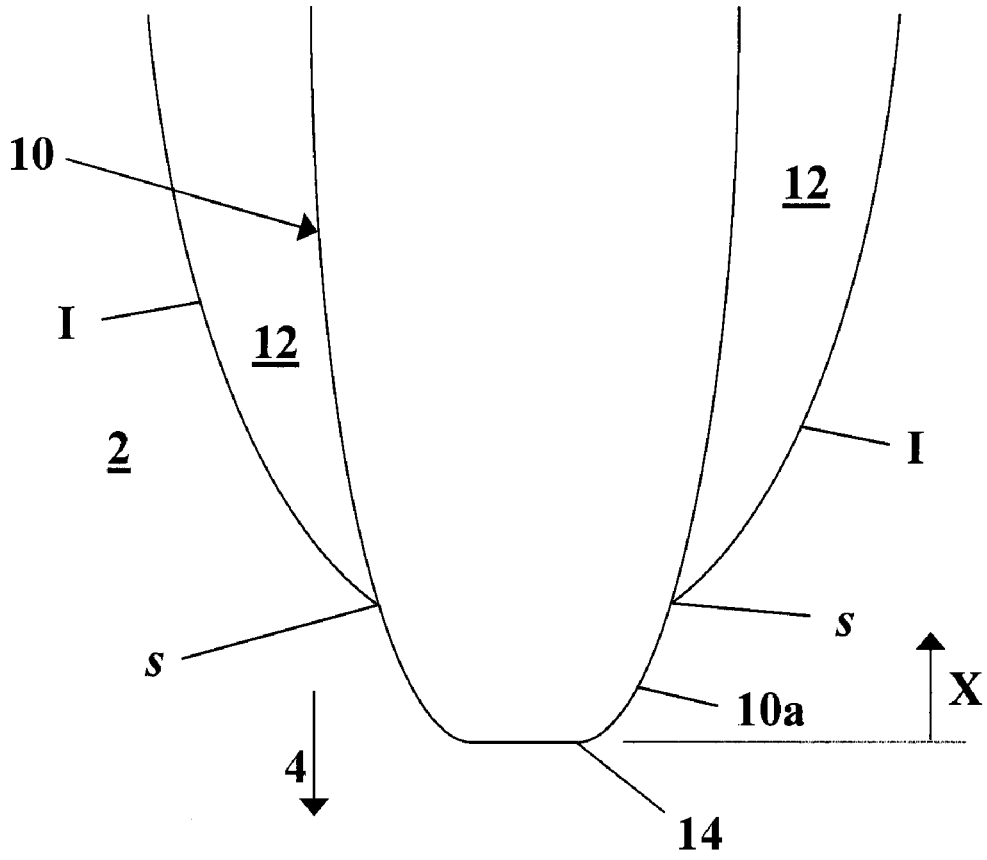
FIG. 1 (PRIOR ART)
FIG. 1 illustrates a prior art vehicle traveling through a fluid medium and having formed a cavity.

Referring now to FIG. 1, there is shown a side view of a prior art vehicle 10 upon entry into fluid medium 2. Vehicle 10 has a pressure field associated with its motion in medium 2 in the direction of arrow 4. At a point s along vehicle 10, cavity 12 forms. Line I of FIG. 1 illustrates the interface between cavity 12 and medium 2. As is known in the art, the location where cavity 12 forms will depend on the geometry of vehicle 10.

Figure 2:
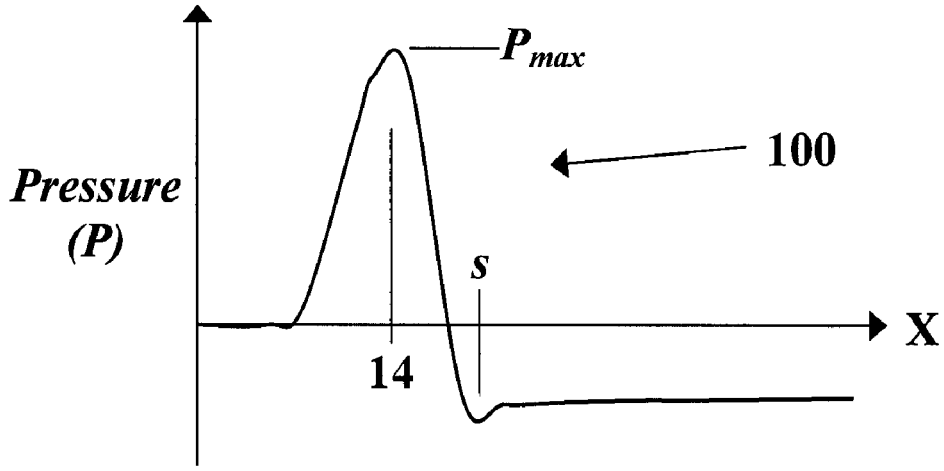
FIG. 2 is a plot of the pressure field about the vehicle of FIG. 1.

Referring also to FIG. 2, there is shown a plot 100 of the pressure field along the contour of vehicle 10. Starting from an arbitrary point forward of vehicle 10 and proceeding in a direction indicated by arrow X, FIG. 2 indicates that the pressure increases and reaches a maximum ($P_{max}$) at a stagnation region 14 along forward portion 10*a* of vehicle 10. Stagnation region 14 is the region on the vehicle substantially perpendicular to major hydrodynamic flow where pressure is at a relative maximum and velocity is at a relative minimum. Continuing along vehicle 10 to point s, plot 100 indicates that the pressure drops at the formation of cavity 12. As shown in plot 100, the pressure within cavity 12 is low compared with that at stagnation region 14. This pressure difference may be used to passively drive a flow.

As is known to those of skill in the art, the geometry of vehicle 10 may result in a thin vapor layer being formed at forward portion of vehicle 10 (not shown in FIG. 1). However, the pressure in the vapor layer would also be at the stagnation pressure such that the shape of plot 100 would remain generally the same and the pressure difference also may be used to passively drive a flow, in this case, of vapor. For clarity, but not limitation, the following discussion is directed to the case where no vapor layer is formed.

Figure 3:
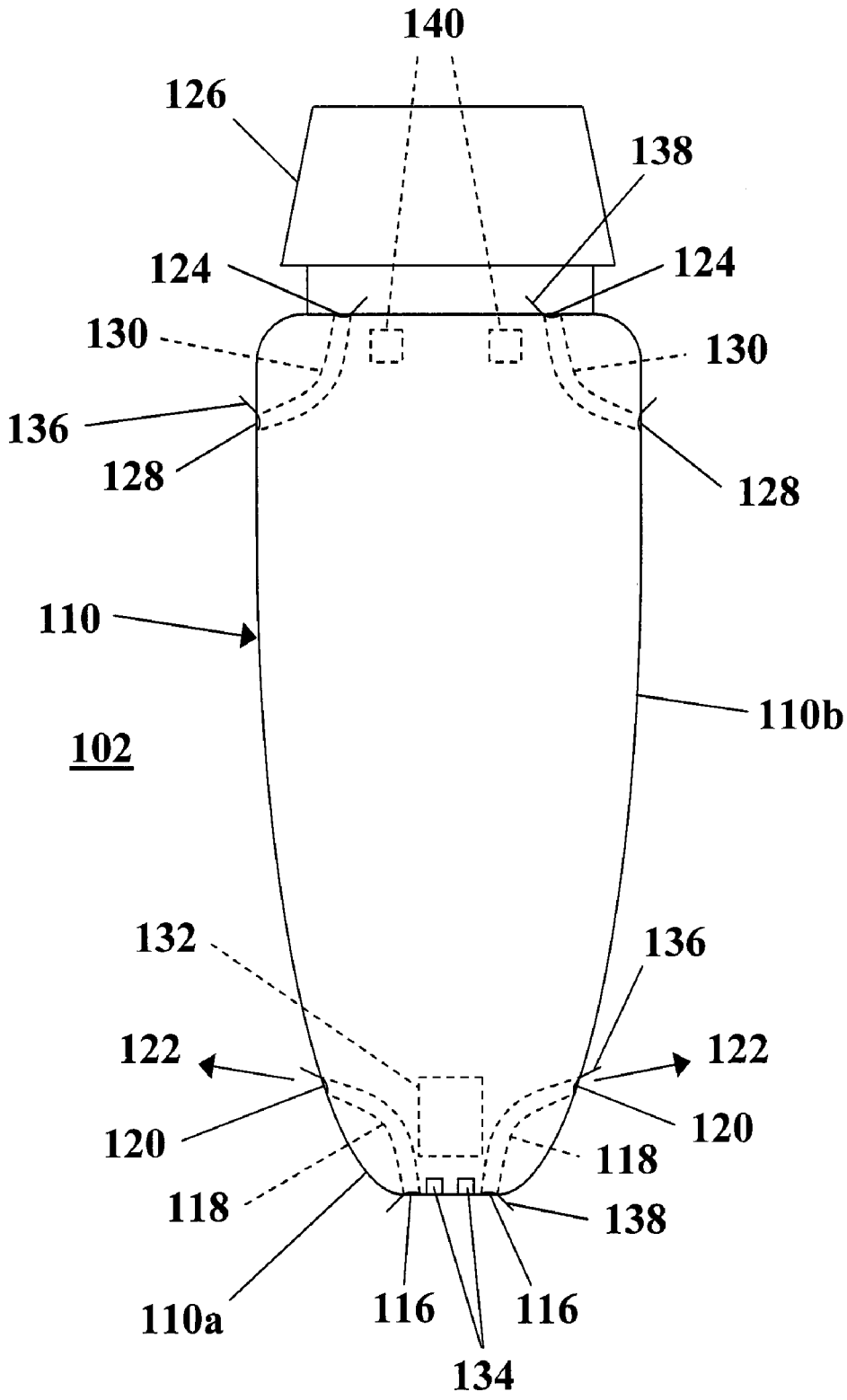
FIG. 3 illustrates a vehicle having flow passages and traveling through a fluid medium.

Referring now to FIG. 3, there is shown a side view of vehicle 110 upon entry within fluid medium 102. A series of inlet ports 116 are positioned in forward portion 110*a* of vehicle 110, corresponding to stagnation region 14 of FIG. 1. Flow passages 118, shown in phantom in FIG. 3, connect inlet ports 116 to outlet ports 120. Generally, the exterior geometry of vehicle 110 corresponds with that of vehicle 10 of FIG. 1 with the exception of inlet ports 116 and outlet ports 120. Outlet ports 120 are positioned along vehicle 110 at locations within cavity region 12 along vehicle 10 of FIG. 1.

The pressure difference between inlet ports 116 and outlet ports 120 causes flow jets to form in passages 118. Passages 118 and outlet ports 120 are configured such that the major component of flow is directed normal to a potential cavity boundary that would otherwise form along vehicle 110.

The normal flow (indicated by arrows 122) can increase drag on vehicle 110 in two manners to varying degrees depending on the chosen geometry of vehicle 110, inlet ports 116, passages 118 and outlet ports 120. As the sizes of the inlet ports 116, passages 118, or outlet ports 120 are increased, the normal flow will increase. Increased normal flow broadens the free stream flow streamlines such that a larger pressure drag is produced.

In addition, the normal flow induces wave formation on the boundary of an incipient cavity so as to hinder the formation of a stable cavity. The incipient cavity quickly breaks down and surface 110*b* of vehicle 110 is wetted, increasing skin friction drag. Both the increased pressure drag and increased skin friction drag slow vehicle 110 more quickly than would otherwise be the case without the effects of the normal flow.

As shown in FIG. 3, rear inlets 124 can be positioned in the region of propulsor 126 to similarly drive flow to rear outlets 128 through rear passages 130. Being positioned on the body away from the transition region, rear outlets 128 act to increase friction drag.

Flow passages 118 are confined such that instrumentation 132 can be positioned within forward portion 110*a* of vehicle 110 to control operation of vehicle 110. Additionally, sensors 134 can be located in forward portion 110*a* to determine when vehicle 110 has slowed sufficiently below the speed where cavity formation is a concern. Sensors 134 can be any type of fluid velocity sensor capable of detecting fluid speed in the region about vehicle 110. Outlet covers 136 and inlet covers 138 joined to actuators can be provided for sealing outlet ports 120 and inlet ports 116 when not in use. Rear outlets 128 and rear inlets 124 can also be provided with outlet covers 136 and inlet covers 138. Readings from sensors 134 can cause one or more controllers 140 to activate outlet covers 136 to seal outlet ports 120 and rear outlets 128 to minimize drag on vehicle 110. For clarity but not limitation, controllers 140 are shown adjacent rear inlets 124.

What have thus been described are systems for increasing the drag of an underwater vehicle by disrupting the cavity that forms during high-speed transit of the vehicle through the water. Inlet ports are positioned in regions of the vehicle where pressure stagnation occurs during transit. Flow passages connect these inlets to outlet ports at regions of lower pressure. The pressure differences cause jets to flow in the respective passages.

The jets are directed normal to the cavity boundary. The jets can broaden the cavity to increase drag and slow the vehicle. Additionally, or in combination, the jets can cause waves on the cavity interface to break down the stable cavity, which results in the vehicle surface being wetted, producing skin friction drag and slowing the vehicle.

In addition to inlet ports being located at a forward end of the vehicle, inlet ports may also be located near the vehicle propulsor unit. Corresponding outlet ports can be similarly positioned near the rear of the vehicle, with jets generally normal to the vehicle surface to increase friction drag and also slow the vehicle.

Sensors and other instrumentation for controlling the vehicle can be positioned at a forward end of the vehicle and can ascertain the speed of the vehicle. Once the vehicle has slowed to operational speed, the sensors can activate covers that can close the ports. The covers can decrease the noise radiated by the vehicle and hence increase the stealth of the vehicle.

By disrupting the cavity and slowing the vehicle, the systems described herein allow water entry of high-speed underwater vehicles in shallow depths, such as when torpedoes are air dropped into shallow water. The systems operate without the need for a pump, thus eliminating a cause of radiated noise.

Obviously many modifications and variations of the present invention may become apparent in light of the above teachings. For example, the flow through the passages can be controlled by the sensors selectively activating the port covers. In this manner, the rate of slowing can be controlled.

It will be understood that many additional changes in details, materials, steps, and arrangements of parts which have been described herein and illustrated in order to explain the nature of the invention, may be made by those skilled in the art within the principle and scope of the invention as expressed in the appended claims.

What is claimed is:

1. An aquatic vehicle comprising:

a hull having a stagnation region and a known cavity formation region thereabout at which cavities tend to form at operating speeds;

at least one inlet port formed in said hull and positioned at said stagnation region;

at least one outlet port formed in said hull and positioned at said known cavity formation region; and at least one passageway within said hull connecting said at least one inlet port and said at least one outlet port, a pressure difference between said at least one inlet port and said at least one outlet port being capable of causing a flow of environmental water through said at least one passageway from said at least one inlet port to said at least one outlet port, said at least one outlet port directing said flow away from said hull, said flow disrupting cavity formation about said hull.

2. A system according to claim 1 further comprising a propulsor joined to said hull, said hull having a propulsor region proximate to said propulsor, said at least one inlet port being positioned at the propulsor region.

3. A system according to claim 2, further comprising at least one closable cover positioned on said hull proximate said at least one outlet port.

4. A system according to claim 3, further comprising at least one closable cover positioned on said hull proximate said at least one inlet port.

5. A system according to claim 3, further comprising:

at least one sensor positioned on said hull capable of measuring a speed of the vehicle; and a controller joined to said at least one sensor capable of selectively opening said at least one closable cover when a speed of the vehicle indicates a tendency to form cavities and closing said at least one closable cover when a speed of the vehicle indicates an absence of a tendency to form cavities.

6. A system according to claim 1, further comprising at least one closable cover positioned on said hull proximate said at least one outlet port.

7. A system according to claim 6, further comprising:

at least one sensor positioned on said hull capable of measuring a speed of the vehicle; and a controller joined to said at least one sensor capable of selectively opening said at least one closable cover when a speed of the vehicle indicates a tendency to form cavities and closing said at least one closable cover when a speed of the vehicle indicates an absence of a tendency to form cavities.

8. A system according to claim 7, wherein said hull has a forward portion and said at least one sensor is positioned within the forward portion.

9. A cavitation reduction system for an aquatic vehicle having a hull surface, comprising:

a stagnation region of the hull surface having an inlet port formed therein;

a cavity formation region at a known location of the hull surface having an outlet port formed therein, said cavity formation region being on an exterior of said hull surface where cavities tend to form at operating speeds; and a confined passageway for passive flow within said hull surface and fluidly connecting said inlet port and said outlet port, said passageway being capable of confining a flow from said inlet port through said passageway to said outlet port, said outlet port being capable of directing said flow to disrupt formation of a cavity in said cavity formation region.

10. A system according to claim 9, further comprising:

a controller positioned within said hull surface; and a closable cover joined to the hull surface at said outlet port, wherein said controller is capable of selectively opening and closing said closable cover.

11. A system according to claim 9, wherein the aquatic vehicle has a propulsor, and the hull surface has a propulsor region proximate to the propulsor having a rear outlet port formed therein, said rear outlet port being in communication with said confined passageway.

12. A system according to claim 11, further comprising:

a controller positioned within the hull surface; and a rear closable cover joined to the hull surface at said rear outlet port, wherein said controller is capable of selectively opening and closing said rear closable cover.

13. A system according to claim 11, wherein said propulsor region of the hull surface has a rear inlet port formed therein, said system further comprising a passageway within the hull surface joining said rear inlet port to said rear outlet port.

14. A system according to claim 10 further comprising at least one sensor positioned on said hull surface capable of measuring a speed of the vehicle, said controller being joined to said at least one sensor and said closable cover, said controller being capable of issuing a command to open said at least one closable cover when a speed of the vehicle indicates a tendency to form cavities and issuing a command to close said at least one closable cover when a speed of the vehicle indicates an absence of any tendency to form cavities.

* * * * *